US010677466B2

(12) United States Patent
Berry et al.

(10) Patent No.: US 10,677,466 B2
(45) Date of Patent: Jun. 9, 2020

(54) COMBUSTOR INLET FLOW CONDITIONER

(71) Applicant: General Electric Company, Schenectady, NY (US)

(72) Inventors: Jonathan Dwight Berry, Simpsonville, SC (US); Brandon Lamar Bush, Simpsonville, SC (US); Timothy James Purcell, Greenville, SC (US); Lucas John Stoia, Taylors, SC (US)

(73) Assignee: General Electric Company, Schenectady, NY (US)

( * ) Notice: Subject to any disclaimer, the term of this patent is extended or adjusted under 35 U.S.C. 154(b) by 570 days.

(21) Appl. No.: 15/292,485

(22) Filed: Oct. 13, 2016

(65) Prior Publication Data

US 2018/0106482 A1 Apr. 19, 2018

(51) Int. Cl.

| | |
|---|---|
| ***F23R 3/28*** | (2006.01) |
| ***F23R 3/04*** | (2006.01) |
| ***F23R 3/00*** | (2006.01) |

(52) U.S. Cl.

CPC ..... *F23R 3/286* (2013.01); *F23R 3/002* (2013.01); *F23R 3/04* (2013.01); *F23R 2900/00012* (2013.01)

(58) Field of Classification Search

CPC .. F23R 3/04; F23R 3/286; F23R 3/002; F23R 3/06; F23R 3/10; F23R 3/26; F23R 3/54; F23R 2900/00012; F05D 2240/35

See application file for complete search history.

(56) References Cited

U.S. PATENT DOCUMENTS

| | | | | |
|---|---|---|---|---|
| 5,450,725 | A * | 9/1995 | Takahara | F23R 3/286 60/737 |
| 6,634,175 | B1 | 10/2003 | Kawata et al. | |
| 6,860,098 | B2 | 3/2005 | Suenaga et al. | |
| 6,920,758 | B2 * | 7/2005 | Matsuyama | F23R 3/286 431/114 |
| 7,574,865 | B2 * | 8/2009 | Bland | F23R 3/04 60/752 |
| 7,762,074 | B2 | 7/2010 | Bland et al. | |
| 8,490,400 | B2 | 7/2013 | Koenig et al. | |
| 9,163,837 | B2 | 10/2015 | Sutcu et al. | |
| 9,291,352 | B2 | 3/2016 | Stewart et al. | |
| 10,139,109 | B2 * | 11/2018 | Thackway | F23R 3/286 |
| 2007/0227148 | A1 * | 10/2007 | Bland | F23R 3/04 60/752 |
| 2010/0136496 | A1 * | 6/2010 | Kashihara | F23R 3/286 431/285 |
| 2010/0186413 | A1 * | 7/2010 | Lacy | F23R 3/10 60/740 |
| 2011/0000215 | A1 * | 1/2011 | Lacy | F23M 9/02 60/746 |

(Continued)

*Primary Examiner* — Carlos A Rivera

(74) *Attorney, Agent, or Firm* — Dority & Manning, P.A.

(57) ABSTRACT

A combustor includes an inlet flow conditioner. The inlet flow conditioner includes a sleeve that circumferentially surrounds a portion of a fuel nozzle assembly and that extends from a forward end of a combustion liner to an inner surface of an end cover. The sleeve defines a plurality of apertures circumferentially spaced about the sleeve. A portion of the inner surface of the end cover and the sleeve define a head end volume of the combustor. An inlet to a premix passage of at least one fuel nozzle of the fuel nozzle assembly is disposed within and is in fluid communication with the head end volume.

10 Claims, 7 Drawing Sheets

(56) References Cited

U.S. PATENT DOCUMENTS

| | | | | |
|---|---|---|---|---|
| 2012/0006029 | A1* | 1/2012 | Bilbao | F23R 3/14 60/737 |
| 2013/0025285 | A1 | 1/2013 | Stewart et al. | |
| 2013/0084534 | A1* | 4/2013 | Melton | F23R 3/10 431/2 |
| 2014/0182294 | A1* | 7/2014 | Matsumoto | F23R 3/286 60/737 |
| 2014/0237784 | A1 | 8/2014 | Lacy et al. | |
| 2014/0260277 | A1* | 9/2014 | DiCintio | F23R 3/005 60/746 |
| 2018/0238239 | A1* | 8/2018 | Stoia | F23R 3/04 |

* cited by examiner

COMBUSTOR INLET FLOW CONDITIONER

STATEMENT REGARDING FEDERALLY SPONSORED RESEARCH OR DEVELOPMENT

This invention was made with Government support under Contract No. DE-FE0023965 awarded by the United States Department of Energy. The Government has certain rights in this invention.

FIELD OF THE TECHNOLOGY

The present invention generally involves a combustor for a gas turbine. More specifically, the invention relates to a system for mitigating non-uniform flow upstream from an inlet to a premix passage of a fuel nozzle.

BACKGROUND

During operation of a gas turbine engine, pressurized air from a compressor flows into a head end volume defined within the combustor. The pressurized air flows from the head end volume into an inlet to a corresponding premix passage of a respective fuel nozzle. Fuel is injected into the flow of pressurized air within the premix passage where it mixes with the pressurized air so as to provide a fuel and air mixture to a combustion zone or chamber defined downstream from the fuel nozzle. The flow of pressurized air is typically non-uniform as it approaches the inlet to the respective fuel nozzle which may be undesirable for efficient combustor operations.

BRIEF DESCRIPTION OF THE TECHNOLOGY

Aspects and advantages are set forth below in the following description, or may be obvious from the description, or may be learned through practice.

One embodiment of the present disclosure is a combustor. The combustor includes an inlet flow conditioner includes a sleeve that circumferentially surrounds a portion of a fuel nozzle assembly. The sleeve extends from a forward end of a combustion liner to an inner surface of an end cover. The sleeve defines a plurality of apertures circumferentially spaced about the sleeve. A portion of the inner surface of the end cover and the sleeve define a head end volume of the combustor. An inlet to a premix passage of at least one fuel nozzle of the fuel nozzle assembly is disposed within and is in fluid communication with the head end volume.

Another embodiment of the present disclosure is a combustor. The combustor includes an inlet flow conditioner that circumferentially surrounds a portion of a fuel nozzle assembly. The inlet flow conditioner extends from a forward end of a combustion liner to an inner surface of an end cover. The inlet flow conditioner comprises an inner sleeve that is radially spaced from an outer sleeve and a flow distribution plenum is defined therebetween. The inner sleeve and the end cover define a head end volume of the combustor. The inner sleeve defines a plurality of apertures which provide for fluid flow between the flow distribution plenum and the head end volume. An inlet to a premix passage of at least one fuel nozzle of the fuel nozzle assembly is disposed within and is in fluid communication with the head end volume.

Those of ordinary skill in the art will better appreciate the features and aspects of such embodiments, and others, upon review of the specification.

BRIEF DESCRIPTION OF THE DRAWINGS

A full and enabling disclosure of the of various embodiments, including the best mode thereof to one skilled in the art, is set forth more particularly in the remainder of the specification, including reference to the accompanying figures, in which.

DETAILED DESCRIPTION

Figure 1:
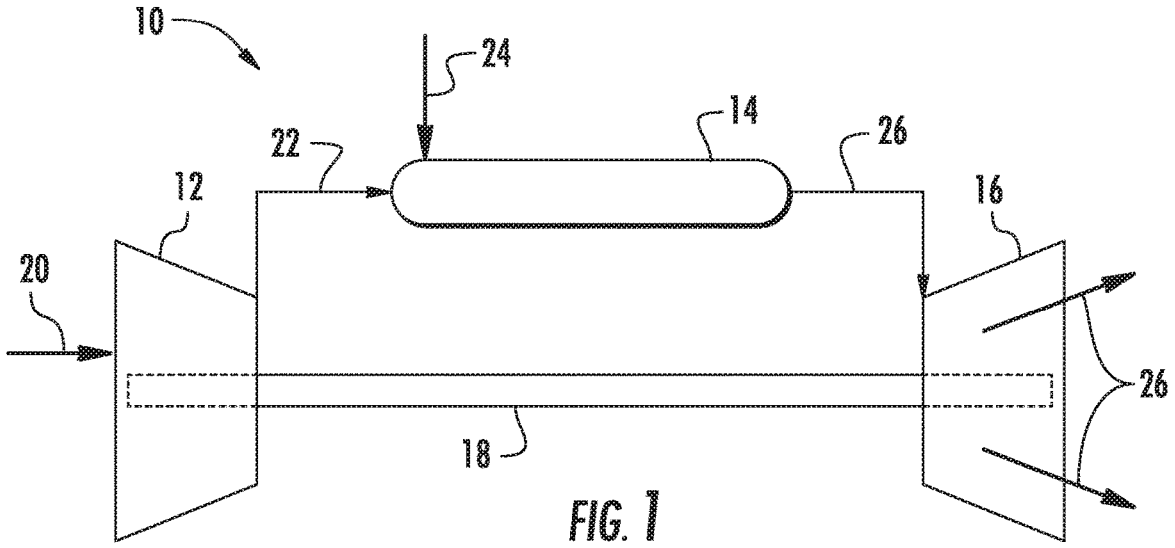
FIG. 1 is a functional block diagram of an exemplary gas turbine that may incorporate various embodiments of the present disclosure.

Reference will now be made in detail to present embodiments of the disclosure, one or more examples of which are illustrated in the accompanying drawings. The detailed description uses numerical and letter designations to refer to features in the drawings. Like or similar designations in the drawings and description have been used to refer to like or similar parts of the disclosure.

As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, the term "axially" refers to the relative direction that is substantially parallel and/or coaxially aligned to an axial centerline of a particular component, and the term "circumferentially" refers to the relative direction that extends around the axial centerline of a particular component.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Each example is provided by way of explanation, not limitation. In fact, it will be apparent to those skilled in the art that modifications and variations can be made without departing from the scope or spirit thereof. For instance, features illustrated or described as part of one embodiment may be used on another embodiment to yield a still further embodiment. Thus, it is intended that the present disclosure covers such modifications and variations as come within the scope of the appended claims and their equivalents. Although exemplary embodiments of the present disclosure will be described generally in the context of a combustor for a land based power generating gas turbine for purposes of illustration, one of ordinary skill in the art will readily appreciate that embodiments of the present disclosure may be applied to any style or type of combustor for a turbomachine and are not limited to combustors or combustion systems for land based power generating gas turbines unless specifically recited in the claims.

Referring now to the drawings, FIG. 1 illustrates a schematic diagram of an exemplary gas turbine 10. The gas turbine 10 generally includes a compressor 12, at least one combustor 14 disposed downstream of the compressor 12 and a turbine 16 disposed downstream of the combustor 14. Additionally, the gas turbine 10 may include one or more shafts 18 that couple the compressor 12 to the turbine 16.

During operation, air 20 flows into the compressor 12 where the air 20 is progressively compressed, thus providing compressed or pressurized air 22 to the combustor 14. At least a portion of the compressed air 22 is mixed with a fuel 24 within the combustor 14 and burned to produce combustion gases 26. The combustion gases 26 flow from the combustor 14 into the turbine 16, wherein energy (kinetic and/or thermal) is transferred from the combustion gases 26 to rotor blades (not shown), thus causing shaft 18 to rotate. The mechanical rotational energy may then be used for various purposes such as to power the compressor 12 and/or to generate electricity. The combustion gases 26 may then be exhausted from the gas turbine 10.

Figure 2:
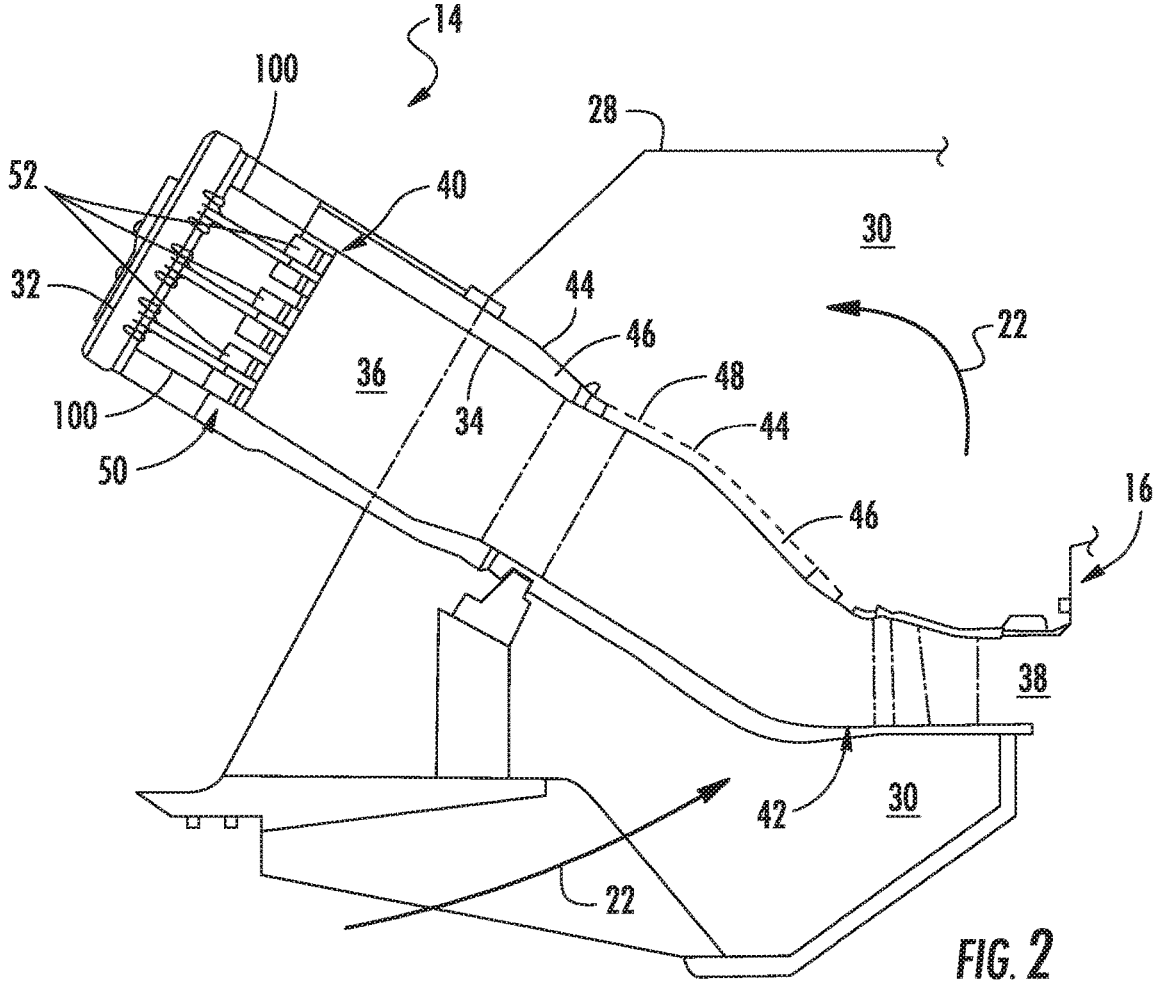
FIG. 2 is a simplified cross-section side view of an exemplary combustor as may incorporate various embodiments of the present disclosure.

As shown in FIG. 2, the combustor 14 may be at least partially surrounded by an outer casing 28 such as a compressor discharge casing. The outer casing 28 may at least partially define a high pressure plenum 30 that at least partially surrounds various components of the combustor 14. The high pressure plenum 30 may be in fluid communication with the compressor 12 (FIG. 1) so as to receive the compressed air 22 therefrom. An end cover 32 may be coupled to the outer casing 28. One or more combustion liners or ducts 34 may at least partially define a combustion chamber or zone 36 for combusting the fuel-air mixture and/or may at least partially define a hot gas path through the combustor 14 for directing the combustion gases 26 towards an inlet 38 to the turbine 16. In particular embodiments, the combustion liner 34 may be formed as or from a singular body or unibody such that an upstream or forward end 40 of the combustion liner 34 is substantially cylindrical or round. The combustion liner 34 may then transition to a non-circular or substantially rectangular cross sectional shape proximate to a downstream or aft end 42 of the combustion liner 34.

In particular embodiments, the combustion liner 34 is at last partially circumferentially surrounded by a flow sleeve 44. The flow sleeve 44 may be formed as a single component or by multiple flow sleeve segments. The flow sleeve 44 is radially spaced from the combustion liner 34 so as to define a flow passage or annular flow passage 46 therebetween. The flow sleeve 44 may define a plurality of inlets or holes 48 which provide for fluid communication between the flow passage 46 and the high pressure plenum 30.

Figure 3:
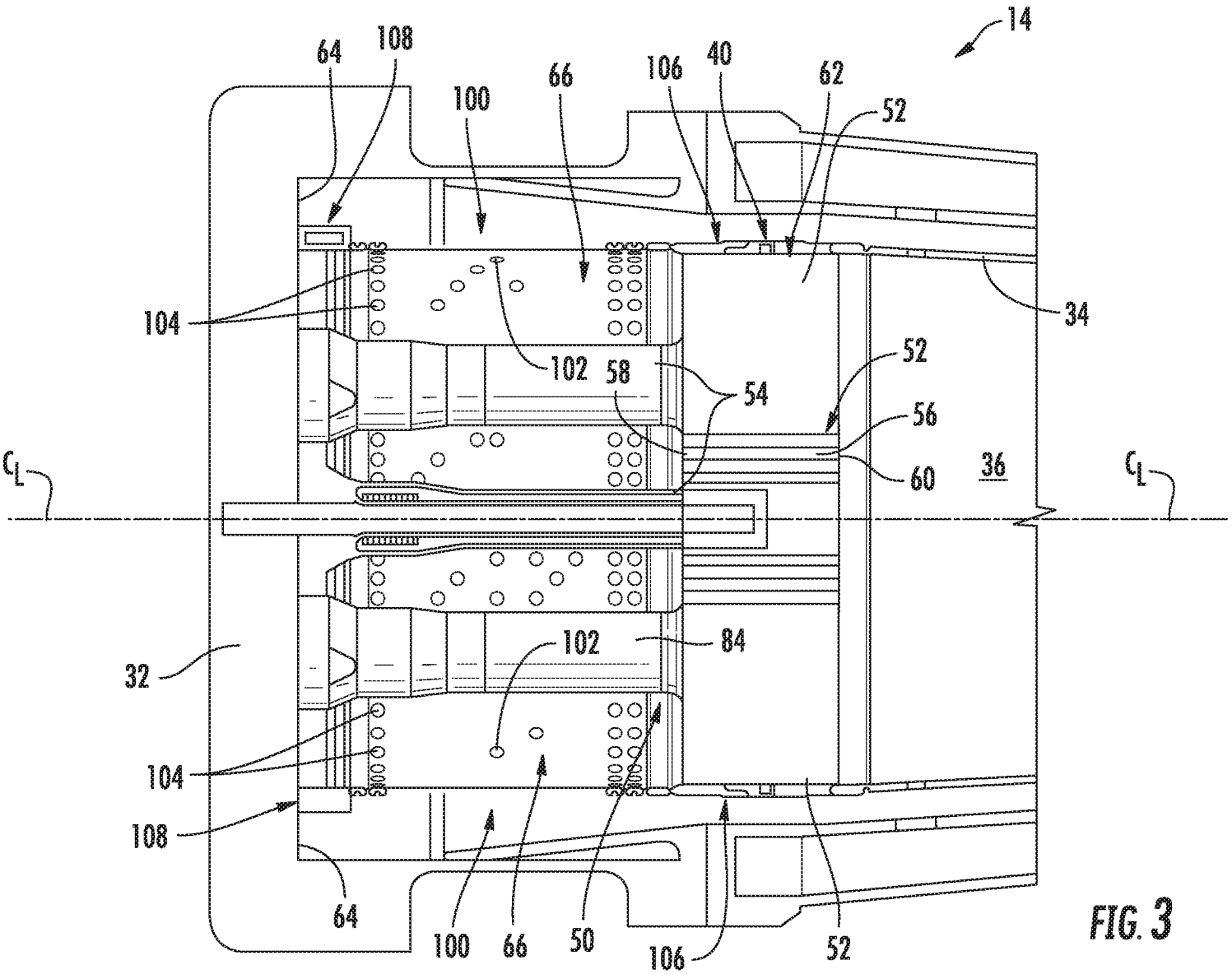
FIG. 3 is a cross section side view of a portion of an exemplary combustor according to at least one embodiment of the present disclosure.

In various embodiments, as shown in FIG. 2, the combustor 14 includes a fuel nozzle or end cap assembly 50. The fuel nozzle assembly 50 generally includes at least one fuel nozzle 52. FIG. 3 provides a cross sectioned side view of a portion of an exemplary combustor 14 according to at least one embodiment of the present disclosure. As shown in FIG. 3, in particular embodiments, each fuel nozzle 52 is fluidly coupled to the end cover 32 via a respective fluid conduit 54. In particular embodiments, the fuel nozzle assembly 50 includes a plurality of fuel nozzles 52 fluidly coupled to the end cover 32 via a corresponding fluid conduit 54.

Each respective fuel nozzle 52 includes at least one premix passage 56 having an inlet 58 defined at an upstream end of the fuel nozzle 52 and an outlet 60 defined at a downstream end of the fuel nozzle 52. The outlet 60 is in fluid communication with the combustion chamber 36 defined within the combustion liner 34. Although the fuel nozzle 52 shown in FIG. 3 is a bundled tube or micro-mixer fuel nozzle, the present invention is not limited to a combustor having a bundled tube fuel nozzle unless otherwise recited in the claims. For example, the fuel nozzle assembly 50 may comprise one or more conventional swirler or swozzle premix type fuel nozzles. In particular embodiments, an aft end 62 of the fuel nozzle assembly 50, such as a portion of the fuel nozzle(s) 52 extends axially into the forward end 40 of the combustion liner 34.

A bundled tube fuel nozzle 52 generally includes a forward or upstream plate, an aft or downstream plate axially spaced from the forward plate and an outer band or sleeve that extends axially between the forward plate and the aft plate. In particular embodiments, the forward plate, the aft plate and the outer sleeve may at least partially define a fuel plenum within the bundled tube fuel nozzle. The respective fluid conduit 54 may extend through the forward plate to provide fuel to the fuel plenum. A tube bundle comprising a plurality of tubes extends through the forward plate, the fuel plenum and the aft plate and each tube defines a respective premix flow passage 56 through the bundled tube fuel nozzle for premixing the fuel with the compressed air within each tube before it is directed into the combustion chamber 36.

In various embodiments, as shown in FIGS. 2 and 3, the combustor 14 includes an inlet flow conditioner 100. In particular embodiments, as shown in FIG. 3, the inlet flow conditioner 100 includes a sleeve 102 that is annularly shaped and that circumferentially surrounds a portion of the fuel nozzle assembly 50. The sleeve 102 extends substantially axially with respect to an axial centerline of the combustor 14 from the forward end 40 of the combustion liner 34 to an inner surface 64 of the end cover 32. A portion of the inner surface 64 of the end cover 32 and the sleeve 102 define a head end volume 66 of the combustor 14. The inlet 58 to the premix passage 56 of the fuel nozzle 52 of the fuel nozzle assembly 50 is disposed within and is in fluid communication with the head end volume 66.

The sleeve 102 defines a plurality of apertures or holes 104 circumferentially spaced about the sleeve 102. In particular embodiments, the plurality of apertures 104 may be uniformly spaced or distributed or may be non-uniformly spaced or distributed along the sleeve 102. In particular embodiments, the plurality of apertures 104 may be uniformly sized or may be sized differently at various axial locations along the sleeve 102. In particular embodiments, the plurality of apertures 104 may be uniformly shaped or may have different shapes defined at various axial locations along the sleeve 102.

In particular embodiments, as shown in FIG. 3, an aft end 106 of the sleeve 102 is connected to the forward end 40 of the combustion liner 34. For example, the aft end 106 of the sleeve 102 may be welded, pined or otherwise fixedly connected to the forward end 40 of the combustion liner 34. In particular embodiments, a forward end 108 of the sleeve 102 is rigidly connected to the end cover 32.

Figure 4:
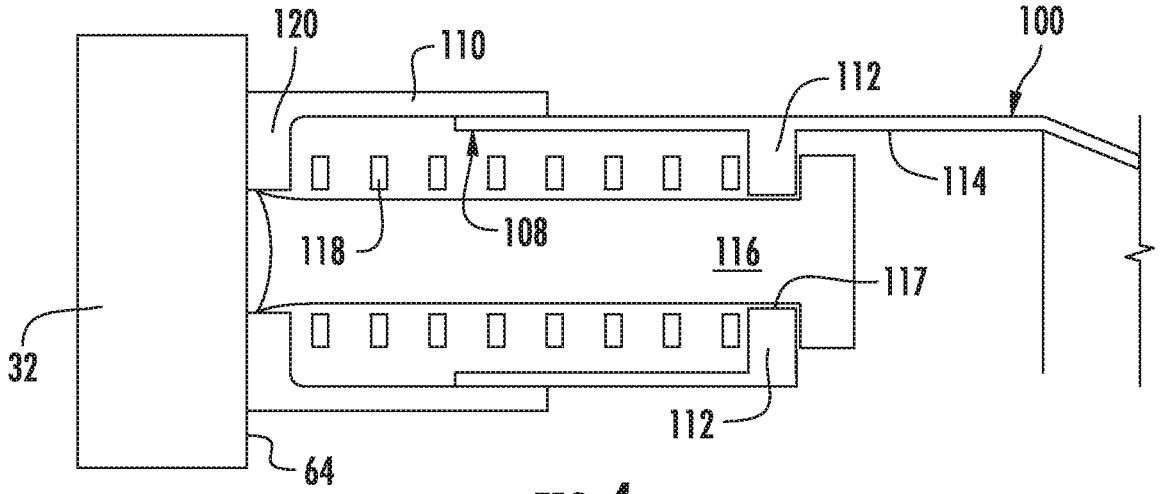
FIG. 4 is a cross section side view of a portion of a forward end of a sleeve of an exemplary inlet flow conditioner according to at least one embodiment of the present disclosure.
Figure 5:
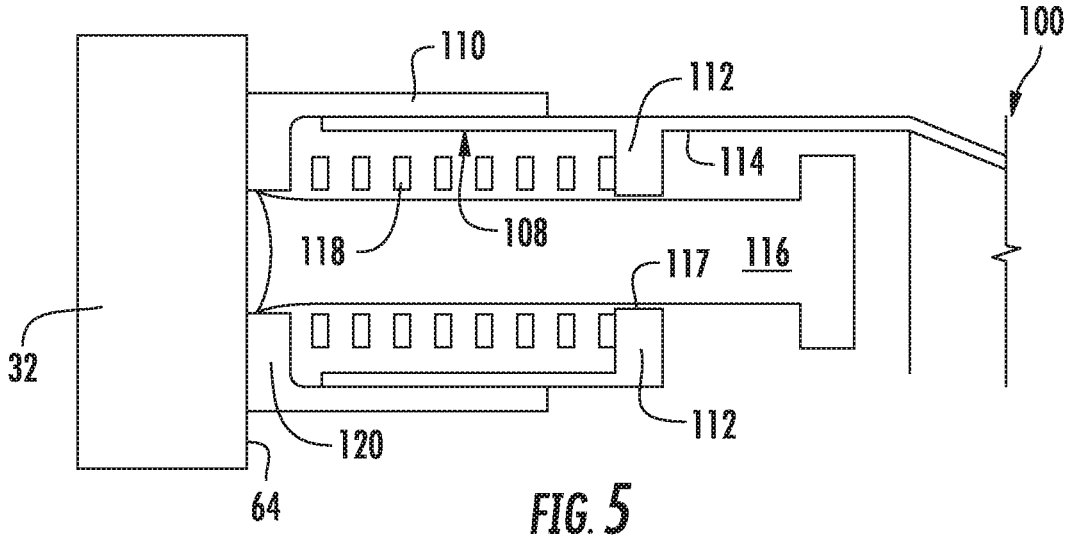
FIG. 5 is a cross section side view of a portion of a forward end of a sleeve of an exemplary inlet flow conditioner according to at least one embodiment of the present disclosure.

During operation of the combustor, the combustion liner 34 and/or the sleeve 102 will expand axially due to thermal growth. In particular embodiments, wherein the aft end 106 of the sleeve 102 is fixedly connected to the forward end 40 of the combustion liner 34, the axial growth of the combustion liner 34 must be considered. FIG. 4 provides a cross section side view of a portion of the forward end 108 of the sleeve 102 according to at least one embodiment of the present disclosure. FIG. 5 provides a cross section side view of a portion of the forward end 108 of the inlet flow conditioner 100 according to at least one embodiment of the present disclosure.

In order to address thermal growth of the combustion liner 34 and/or the sleeve 102, in particular embodiments, as shown in FIGS. 4 and 5 collectively, the forward end 108 of the sleeve 102 may be loaded against the end cover 32 via a channel 110 which is spring loaded. In particular embodiments, the channel 110 is annularly shaped. In particular embodiments, the channel 110 is substantially "U" shaped. The channel 110 may be located on a smooth or flat portion of the inner surface 64 of the end cover 32 or may be disposed within a pocket defined along the inner surface 64 of the end cover 32. The channel 110 may be allowed to slide or reposition while maintaining constant contact with the inner surface 64 to substantially restrict or prevent air flow between the end cover 32 and the sleeve 102 and/or the channel 110.

In particular embodiments, the sleeve 102 includes a projection 112 that extends radially inwardly from an inner surface 114 of the sleeve 102 proximate to the forward end 108. In particular embodiments, the sleeve 102 includes a plurality of the projections 112 where each projection 112 is circumferentially spaced from an adjacent projection of the plurality of projections 112. Each projection 112 extends radially inwardly from the inner surface 114 of the sleeve 102 proximate to the forward end 108.

In particular embodiments, the forward end 108 of the sleeve 102 extends axially into the channel 110. A pin 116 extends axially through a fastener opening 117 defined by the projection 112. The pin 116 may be fixedly connected to a radial wall 120 of the channel 110. The pin 116 may radially align the sleeve 102 with the channel 110 and/or retain the forward end 108 of the sleeve 102 within the channel 110. In particular embodiments, where the sleeve 102 includes a plurality of the projections 112, a plurality of pins 116 may be utilized as described so as to radially align the sleeve 102 with the channel 110 and/or to retain the forward end 108 of the sleeve 102 within the channel 110. In particular embodiments, a spring 118 such as a wave spring or helical spring extends between the radial wall 120 of the channel 110 and the projection 112 of the sleeve 102. The spring 118 may extend circumferentially around a portion of the pin 116.

In operation, as the combustion liner 34 expands axially due to thermal growth, the forward end 108 of the sleeve 102 will be free to move or translate axially and/or radially within the channel 110. The spring 118 provides a compression force between the radial wall 120 and the projection(s) 112 so as to push the combustion liner 34 axially back into its original or desired axial position as the combustion liner 34 and/or the sleeve 102 cools or contracts. The spring 118 also serves to maintain contact between the inner surface 64 and the radial wall 120 of the channel 110.

Figure 6:
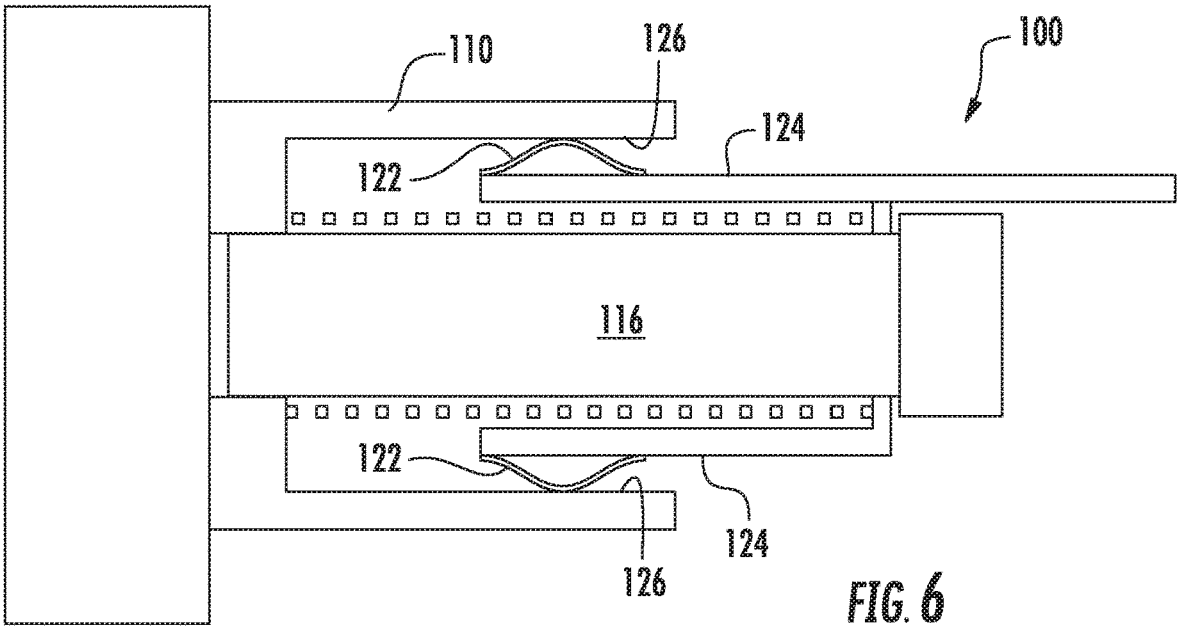
FIG. 6 is a cross section side view of a portion of a forward end of a sleeve of an exemplary inlet flow conditioner according to at least one embodiment of the present disclosure.

FIG. 6 provides a cross section side view of a portion of the forward end 108 of the sleeve 102 according to at least one embodiment of the present disclosure. In particular embodiments, a seal 122 may extend and/or be disposed radially between an outer surface 124 of the forward end 108 of the sleeve 102 and an inner surface 126 of the channel 110. The seal 122 may prevent or reduce leakage of the compressed air 22 around the forward end 108 of the sleeve 102 during operation of the combustor 14. In at least one embodiment, the channel 110 may be rigidly connected or affixed to the inner surface 64 of the end cover 32 via welding, brazing or other mechanical means.

Figure 7:
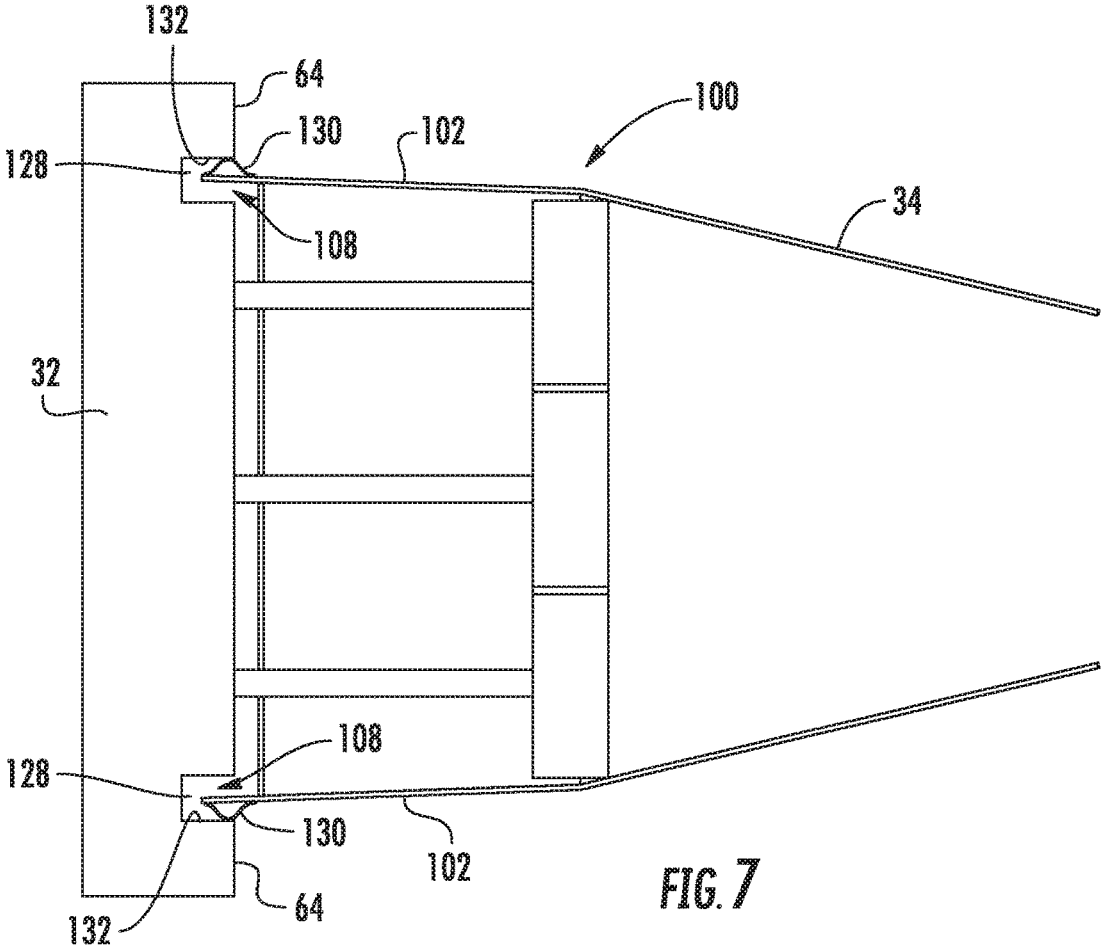
FIG. 7 is a cross section side view of a portion of the combustor 14 according to at least one embodiment of the present disclosure.

FIG. 7 provides a cross section side view of a portion of the combustor 14 according to at least one embodiment of the present disclosure. In particular embodiments, as shown in FIG. 7, the end cover 32 defines a slot 128 that extends along the inner surface 64. The forward end 108 of the sleeve 102 extends axially into the slot 128. In particular embodiments, a spring seal 130 extends radially between the forward end 108 of the sleeve 102 and an inner surface 132 of the slot 128. The spring seal 130 may at least partially form a seal between the forward end 108 of the sleeve 102 and the inner surface 132 of the slot 128. In operation, as the combustion liner 34 expands axially due to thermal growth, the forward end 108 of the sleeve 102 will be free to move or translate axially and/or radially within the slot 128.

Figure 8:
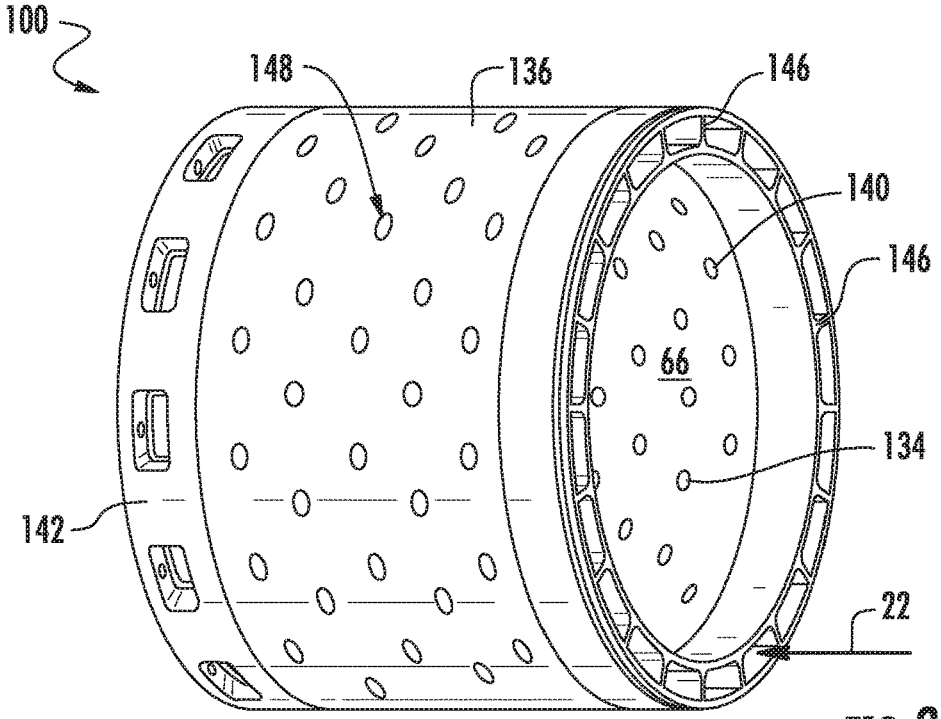
FIG. 8 is a perspective view of an exemplary embodiment of an inlet flow conditioner according to at least one embodiment of the present disclosure.
Figure 9:
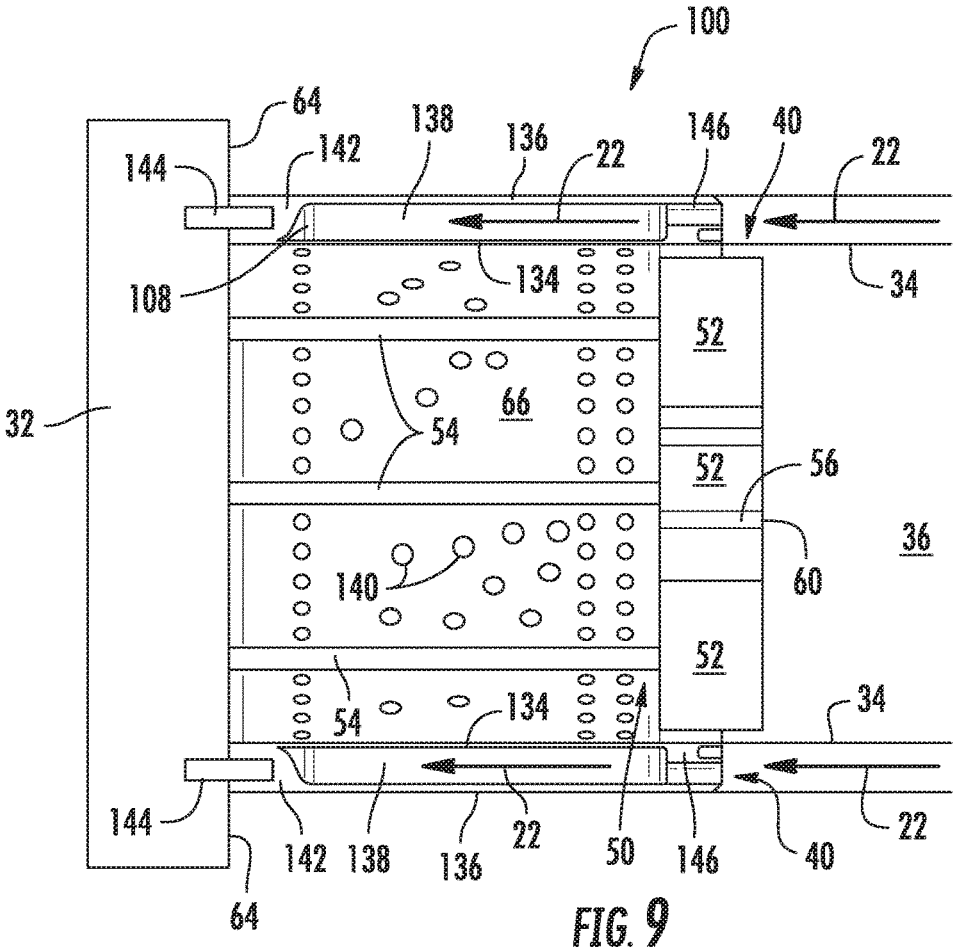
FIG. 9 provides a cross sectional side view of the inlet flow conditioner as shown in FIG. 8, according to at least one embodiment of the present disclosure.

FIG. 8 provides a perspective view of the inlet flow conditioner 100 according to at least one embodiment of the present disclosure. FIG. 9 provides a cross sectional side view of the inlet flow conditioner 100 as shown in FIG. 8 coupled to a portion of the end cover 32. In particular embodiments as shown in FIG. 9, the inlet flow conditioner 100 extends from the forward end 40 of the combustion liner 34 to the inner surface 64 of the end cover 32. In particular embodiments as shown in FIGS. 8 and 9 collectively, the inlet flow conditioner 100 includes an inner sleeve 134 radially spaced from an outer sleeve 136 and a flow distribution plenum 138 (FIG. 9) defined therebetween.

The inner sleeve 134 and the end cover 32 define the head end volume 66 of the combustor 14. The inner sleeve 134 defines a plurality of apertures 140. The plurality of apertures 140 provide for fluid flow between the flow distribution plenum 138 and the head end volume 66. An inlet 58 to at least one premix passage 56 of at least one fuel nozzle 52 of the fuel nozzle assembly 50 is disposed within and is in fluid communication with the head end volume 66. The inner sleeve 134 circumferentially surrounds a portion of the fuel nozzle assembly 50 including the fluid conduit(s) 54.

In particular embodiments, as shown collectively in FIGS. 8 and 9, the inlet flow conditioner 100 further comprises a flange 142 annularly shaped and that extends radially between the inner sleeve 134 and the outer sleeve 136 at the forward end 108 of the inlet flow conditioner 100. The flange 142 may be coupled to the end cover 32. For example, the flange 142 may be coupled to the end cover 32 via a series of pins or mechanical fasteners 144 that extend into the end cover 32. The flange 142 may be at least partially sealed against the inner surface 64 of the end cover 32.

In particular embodiments, as shown collectively in FIGS. 8 and 9, the inlet flow conditioner 100 may include a plurality of diffuser or guide vanes 146 that extend radially and axially between the inner sleeve 134 and the outer sleeve 136 proximate to the aft end 106 of the inlet flow conditioner 100. The diffuser vanes 146 may be disposed upstream from the flow distribution plenum 138. In particular embodiments, as shown in FIG. 8, the outer sleeve 136 of the inlet flow conditioner 100 defines a plurality of holes 148 circumferentially spaced about the outer sleeve 136. The plurality of holes 148 may be in fluid communication with the high pressure plenum 30 (FIG. 2) of the combustor 14. In operation, the diffuser vanes 146 and/or the holes 148 may reduce non-uniformity of the compressed air 22 flowing from the high pressure plenum 30 (FIG. 2) into the flow distribution plenum 138 upstream from the head end volume 66.

Figure 10:
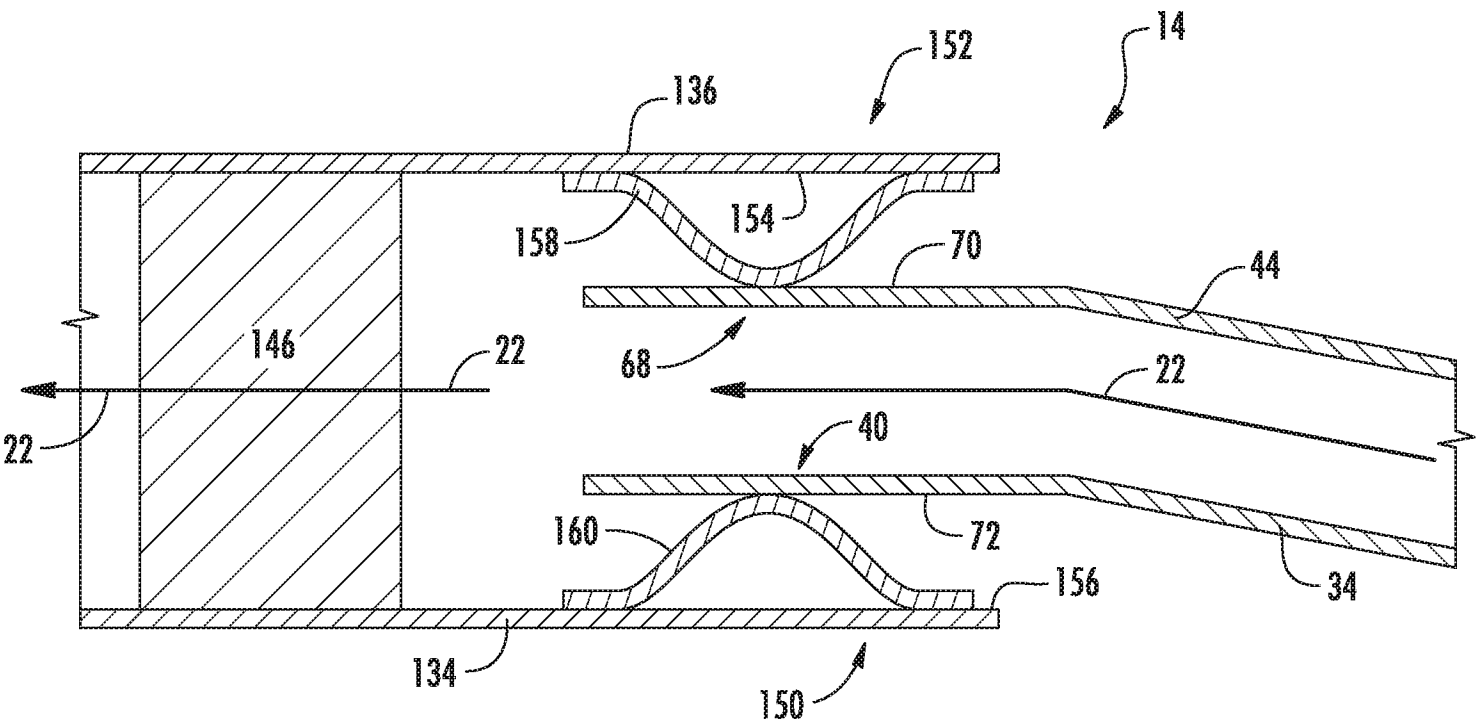
FIG. 10 is an enlarged view of a portion of the combustor 14 including a forward end of a combustion liner, a forward end of a flow sleeve and an aft end of an inner sleeve of the inlet flow conditioner as shown in FIGS. 8 and 9, according to at least one embodiment of the present disclosure.

FIG. 10 provides an enlarged view of a portion of the combustor 14 including the forward end 40 of the combustion liner 34, a forward end 68 of the flow sleeve 44 and an aft end 150 of the inner sleeve 134 and an aft end 152 of the outer sleeve 136 according to at least one embodiment of the present disclosure. In particular embodiments, as shown in FIG. 10, the aft end 152 of the outer sleeve may axially overlap with the forward end 68 of the flow sleeve 44. An outer surface 70 of the flow sleeve 44 may be slideably engaged with an inner surface 154 of the outer sleeve 136. In this manner, the flow sleeve 44 is allowed to slide or translate axially relative to the outer sleeve 136 during operation of the combustor 14, thereby accommodating for thermal expansion and contraction of the combustion liner 34.

In particular embodiments, as shown in FIG. 10, the aft end 150 of the inner sleeve 134 may axially overlap with the forward end 40 of the combustion liner 34. An inner surface 72 of the combustion liner 34 may be slideably engaged with an outer surface 156 of the inner sleeve 134. In this manner, the combustion liner 34 is allowed to slide or translate axially relative to the inner sleeve 134 during operation of the combustor 14, thereby accommodating for thermal expansion and contraction of the combustion liner 34.

In particular embodiments, one or more spring seals 158, 160 may be disposed between the flow sleeve 44 and the outer sleeve 136 and/or between the between the combustion liner 34 and the inner sleeve 134. The seals 158, 160 may reduce or prevent compressed air leakage and/or to impede relative radial movement between the flow sleeve 44 and the outer sleeve 136 and/or between the inner sleeve 134 and the combustion liner 34.

Figure 11:
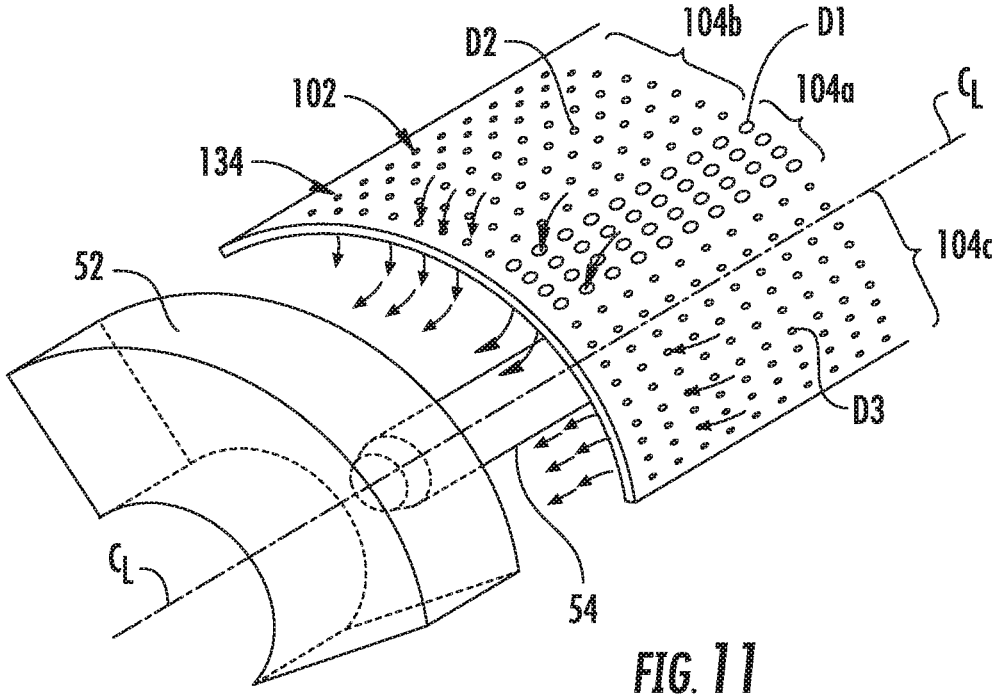
FIG. 11 provides a perspective view of a portion of an exemplary sleeve or inner sleeve of an inlet flow conditioner and a portion of an exemplary fluid conduit according to at least one embodiment of the present disclosure.
Figure 12:
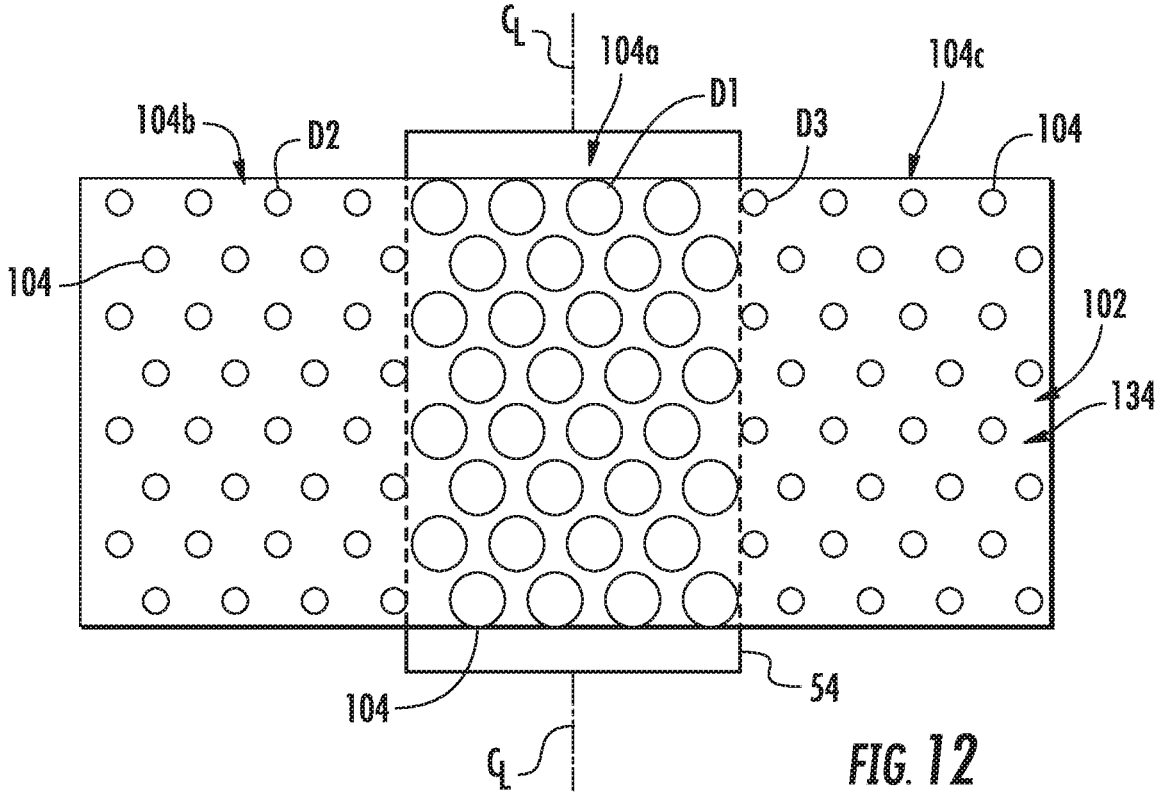
FIG. 12 illustrates a first subset of apertures of a plurality of apertures, a second subset of apertures of the plurality of apertures and a third subset of apertures of the plurality of apertures according to at least one embodiment of the present disclosure.

FIG. 11 provides a perspective view of a portion of the sleeve 102 or inner sleeve 134 and a portion of an exemplary fluid conduit 54 according to at least one embodiment of the present disclosure. FIG. 12 illustrates a first subset of apertures 104*a* of the plurality of apertures 104, a second subset of apertures 104*b* of the plurality of apertures 104 and a third subset of apertures 104*c* of the plurality of apertures 104 according to at least one embodiment of the present disclosure. In various embodiments, as shown in FIGS. 11 and 12 collectively, the first subset of apertures 104*a* is circumferentially aligned with and/or defined radially outwardly from an axial centerline of a corresponding fluid conduit 54. The first subset of apertures 104*a* is disposed circumferentially between the second subset of apertures 104*b* and the third subset of apertures 104*c*. In one embodiment, the apertures 104 of the first subset of apertures 104*a* have a larger diameter D1 than diameters D2, D3 of the apertures 104 of the second subset of apertures 104*b* and the diameters of the apertures 104 of the third subset of apertures 104*c* respectively. The diameters D1 of the apertures 104 of the first subset of apertures 104*a* may be uniform or the same in an axial plane along the sleeve 102 or the inner sleeve 134.

In particular embodiments, as illustrated in FIG. 12, the diameter D2 of one or more apertures 104 of the second subset of apertures 104*b* may be between about 0.04 inches to about 0.13 inches. In particular embodiments, the diameter D3 of one or more apertures 104 of the third subset of apertures 104*c* may be between about 0.04 inches to about 0.13 inches. In particular embodiments, the diameter D2 of one or more apertures 104 of the second subset of apertures 104*b* may be less than or equal to the diameter D3 of one or more apertures 104 of the third subset of apertures 104*c*. In particular embodiments, the diameters D1 of the apertures 104 of the first subset of apertures 104*a* may be greater than or equal to about five times the diameter D2 of the apertures 104 of the second subset of apertures 104 and/or the diameter D3 of the apertures 104 of the third subset of apertures 104*c*.

During operation, as shown in FIGS. 2 through 12 collectively, compressed air 22 from the high pressure plenum 30 flows into the flow distribution plenum 138. In particular embodiments, the diffuser vanes 146 direct or guide the flow of compressed air 22 into the flow distribution plenum 138. In particular embodiments, at least a portion of the compressed air enters the flow distribution plenum 138 via the holes 148 defined in the outer sleeve 136. The compressed air 22 then flows through the apertures 104, 140 and into the head end volume 66. The apertures 104, 140 reduce non-uniformity of the compressed air 22 as it enters the head end volume 66. The compressed air 22 having a substantially uniform flow field, enters the inlet(s) 58 of the premix passage(s) 56 of the fuel nozzle 52 in a substantially uniform fashion where fuel is injected into the flow of the compressed air 22. The fuel and compressed air mix and the mixture is injected into the primary combustion chamber 36 where it is burned to produce combustion gases. The fluid conduits 54 may cause non-uniformity at the inlet(s) 58 of the premix passage(s) 56 of the fuel nozzle(s) 52 if all of the apertures 104 have the same diameters. However, by making the apertures 104 of the second subset of apertures 104*b* and the apertures of the third subset of apertures 104*c* smaller (i.e. smaller diameter) that the diameters D1 of the apertures 104 of the first subset of apertures 104*a*, a uniform or substantially uniform flow into the head end volume 66 or into the inlet(s) 58 of the premix passage(s) 56 of the fuel nozzle(s) 52 may be realized.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A combustor, comprising:

an end cover;

a fuel nozzle assembly including at least one fuel nozzle mounted to the end cover and having an outer band that extends in an axial direction;

a combustion liner downstream of the fuel nozzle assembly;

a flow sleeve circumferentially surrounding the combustion liner;

an inlet flow conditioner circumferentially surrounding a portion of the fuel nozzle assembly, wherein the inlet flow conditioner extends axially from a forward end of the liner to an inner surface of the end cover, wherein the inlet flow conditioner comprises:

an outer sleeve comprising an aft end, the aft end of the outer sleeve axially overlapping a forward end of the flow sleeve;

an inner sleeve radially spaced between the outer sleeve and the outer band, the inner sleeve comprising an aft end, the aft end of the inner sleeve axially overlapping the forward end of the combustion liner;

a plurality of apertures defined in the inner sleeve;

a flow distribution plenum defined between the inner sleeve of the inlet flow conditioner and the outer sleeve of the inlet flow conditioner, wherein the inner sleeve and the end cover define a head end volume of the combustor, wherein the plurality of apertures provide for fluid flow between the flow distribution plenum and the head end volume, wherein an inlet to the at least one fuel nozzle of the fuel nozzle assembly is disposed within and is in fluid communication with the head end volume; and a plurality of diffuser vanes that extend radially from the inner surface of the outer sleeve to the outer surface of the inner sleeve proximate to an aft end of the inlet flow conditioner, wherein the plurality of diffuser vanes is disposed upstream from the flow distribution plenum relative to a flow direction of compressed air traveling therethrough.

2. A gas turbine, comprising:

a compressor;

a turbine; and a combustor disposed downstream from the compressor and upstream from the turbine, the combustor comprising:

an end cover;

a fuel nozzle assembly including at least one fuel nozzle mounted to the end cover and having an outer band that extends in an axial direction;

a combustion liner downstream of the fuel nozzle assembly;

a flow sleeve circumferentially surrounding the combustion liner;

an inlet flow conditioner circumferentially surrounding a portion of the fuel nozzle assembly, wherein the inlet flow conditioner extends from a forward end of the liner to an inner surface of the end cover, wherein the inlet flow conditioner comprises:

an outer sleeve comprising an aft end, the aft end of the outer sleeve axially overlapping a forward end of the flow sleeve, an outer surface of the flow sleeve slideably and sealingly engaged with an inner surface of the outer sleeve;

an inner sleeve radially spaced between the outer sleeve and the outer band, the inner sleeve comprising an aft end, the aft end of the inner sleeve axially overlapping the forward end of the combustion liner, an inner surface of the combustion liner slideably and sealingly engaged with an outer surface of the inner sleeve;

a plurality of apertures defined in the inner sleeve;

a flow distribution plenum defined between the inner sleeve of the inlet flow conditioner and the outer sleeve of the inlet flow conditioner, wherein the inner sleeve and the end cover define a head end volume of the combustor, wherein the plurality of apertures provide for fluid flow between the flow distribution plenum and the head end volume, wherein an inlet to the at least one fuel nozzle of the fuel nozzle assembly is disposed within and is in fluid communication with the head end volume; and a plurality of diffuser vanes that extend radially from the inner surface of the outer sleeve to the outer surface of the inner sleeve proximate to an aft end of the inlet flow conditioner, wherein the plurality of diffuser vanes is disposed upstream from the flow distribution plenum relative to a flow direction of compressed air traveling therethrough.

3. The combustor as in claim 2, wherein the at least one fuel nozzle is fluidly coupled to the end cover via a fluid conduit, wherein the fluid conduit is disposed within the head end volume.

4. The combustor as in claim 3, wherein the plurality of apertures comprises a first subset of apertures circumferentially aligned with the fluid conduit, a second subset of apertures and a third subset of apertures, wherein the first subset of apertures is disposed circumferentially between the second subset of apertures and the third subset of apertures and wherein the second subset of apertures and the third subset of apertures are circumferentially offset from the fluid conduit.

5. The combustor as in claim 4, wherein the apertures of the first subset of apertures are larger than the apertures of the second subset of apertures and the third subset of apertures.

6. The combustor as in claim 4, wherein the apertures of the first subset of apertures are uniform in diameter.

7. The combustor as in claim 4, wherein a diameter of each aperture of the second subset of apertures is less than or equal to a diameter of each aperture of the third subset of apertures.

8. The combustor as in claim 2, wherein the plurality of diffuser vanes is configured to reduce non-uniformity of compressed air flowing from a compressor into the flow distribution plenum upstream from the head end volume.

9. The combustor as in claim 2, further comprising a flange that extends radially between the inner sleeve and the outer sleeve at a forward end of the inlet flow conditioner, wherein the flange is coupled to the end cover by a series of pins that extend into the end cover, whereby the flange is in contact with the inner surface of the end cover and at least partially sealed against the inner surface of the end cover.

10. The combustor as in claim 9, wherein both the inner sleeve and the outer sleeve extend from the forward end of the liner to the flange.

* * * * *